US009901966B2

(12) United States Patent
Taras et al.

(10) Patent No.: US 9,901,966 B2
(45) Date of Patent: Feb. 27, 2018

(54) METHOD FOR FABRICATING FLATTENED TUBE FINNED HEAT EXCHANGER

(71) Applicant: Carrier Corporation, Farmington, CT (US)

(72) Inventors: Michael F. Taras, Fayetteville, NY (US); Arindom Joardar, East Syracuse, NY (US); Melkamu Woldesemayat, Liverpool, NY (US); Bruce J. Poplawski, Mattydale, NY (US)

(73) Assignee: CARRIER CORPORATION, Farmington, CT (US)

( * ) Notice: Subject to any disclaimer, the term of this patent is extended or adjusted under 35 U.S.C. 154(b) by 674 days.

(21) Appl. No.: 14/376,205

(22) PCT Filed: Jan. 29, 2013

(86) PCT No.: PCT/US2013/023532

§ 371 (c)(1),
(2) Date: Aug. 1, 2014

(87) PCT Pub. No.: WO2013/116177

PCT Pub. Date: Aug. 8, 2013

(65) Prior Publication Data

US 2015/0000133 A1 Jan. 1, 2015

Related U.S. Application Data

(60) Provisional application No. 61/593,998, filed on Feb. 2, 2012.

(51) Int. Cl.
*F28D 1/053* (2006.01)
*B21C 37/06* (2006.01)
(Continued)

(52) U.S. Cl.
CPC ..... *B21C 37/06* (2013.01); *F28D 1/05391* (2013.01); *F28F 1/128* (2013.01);
(Continued)

(58) Field of Classification Search
CPC ..... B21C 37/06; F28F 17/005; F28F 1/128; F28F 9/0131; F28F 9/0132;
(Continued)

(56) References Cited

U.S. PATENT DOCUMENTS 5,203,407 A * 4/1993 Nagasaka ..... F28D 1/05375 165/174
6,408,939 B1 * 6/2002 Sugimoto ..... F28D 1/0435 165/135
(Continued)

FOREIGN PATENT DOCUMENTS

CN 101216209 A 7/2008
CN 101776411 A 7/2010
(Continued)

OTHER PUBLICATIONS

Chinese First Office Action and Search Report for application CN 201380007735.0, dated Jan. 21, 2016, 7 pages.
(Continued)

*Primary Examiner* — Sarang Afzali
*Assistant Examiner* — Ruth G Hidalgo-Hernandez
(74) *Attorney, Agent, or Firm* — Cantor Colburn LLP

(57) ABSTRACT

A method is disclosed for assembling a flattened tube multiple tube bank heat exchanger that includes a first tube bank and a second tube bank, each bank including a plurality tube segments extending longitudinally in spaced parallel relationship. A spacer clip is installed on a longitudinally extending edge of each heat exchange tube segment arrayed in a first layer of tube segments. A plurality of heat exchange tube segments are arrayed in a second layer in engagement
(Continued)

with the spacer clips installed on the tube segments of the first layer.

17 Claims, 6 Drawing Sheets

(51) Int. Cl.
*F28F 9/013* (2006.01)
*F28F 17/00* (2006.01)
*F28F 1/12* (2006.01)
*F28D 21/00* (2006.01)

(52) U.S. Cl.
CPC ..... *F28F 9/0131* (2013.01); *F28F 9/0132* (2013.01); *F28F 17/005* (2013.01); *F28D 2021/0068* (2013.01); *F28F 2240/00* (2013.01); *Y10T 29/49359* (2015.01)

(58) Field of Classification Search
CPC ..... F28F 2240/00; F28D 1/05391; F28D 2021/0068; Y10T 29/49359
See application file for complete search history.

(56) References Cited

U.S. PATENT DOCUMENTS

2008/0023186 A1* 1/2008 Beamer ..... F28D 1/05375 165/174
2010/0089559 A1* 4/2010 Gorbounov ..... F25B 39/028 165/174

FOREIGN PATENT DOCUMENTS

DE 20118511 U1 2/2002
EP 1813903 A1 8/2007
EP 1840494 A2 10/2007

OTHER PUBLICATIONS

International Search Report and Written Opinion of the International Searching Authority for International Patent Applicaiton No. PCT/US2013/023532, International Filing Date: Jan. 29, 2013, dated Nov. 15, 2013, 12 Pages.

* cited by examiner

METHOD FOR FABRICATING FLATTENED TUBE FINNED HEAT EXCHANGER

BACKGROUND OF THE INVENTION

This invention relates generally to heat exchangers and, more particularly, to flattened tube and fin heat exchangers and the fabrication of same.

BACKGROUND OF THE INVENTION

Heat exchangers have long been used as evaporators and condensers in heating, ventilating, air conditioning and refrigeration (HVACR) applications. Historically, these heat exchangers have been round tube and plate fin (RTPF) heat exchangers. However, all aluminum flattened tube and fin heat exchangers are finding increasingly wider use in industry, including the HVACR industry, due to their compactness, thermal-hydraulic performance, structural rigidity, lower weight and reduced refrigerant charge, in comparison to conventional RTPF heat exchangers.

A typical flattened tube and fin heat exchanger includes a first manifold, a second manifold, and a single tube bank formed of a plurality of longitudinally extending flattened heat exchange tubes disposed in spaced parallel relationship and extending between the first manifold and the second manifold. The first manifold, second manifold and tube bank assembly is commonly referred to in the heat exchanger art as a slab. Additionally, a plurality of fins are disposed between each neighboring pair of heat exchange tubes for increasing heat transfer between a fluid, commonly air in HVACR applications, flowing over the outer surface of the flattened tubes and along the fin surfaces and a fluid, commonly refrigerant in HVACR applications, flowing inside the flattened tubes. Such single tube bank heat exchangers, also known as single slab heat exchangers, have a pure cross-flow configuration. In an embodiment of flattened tube commonly used in HVACR applications, the interior of the flattened tube is subdivided into a plurality of parallel flow channels. Such flattened tubes are commonly referred to in the art as multichannel tubes, mini-channel tubes or micro-channel tubes.

Double bank flattened tube and fin heat exchangers are also known in the art. Conventional double bank flattened tube and fin heat exchangers, also referred to in the heat exchanger art as double slab heat exchangers, are typically formed of two conventional fin and tube slabs, one disposed behind the other, with fluid communication between the manifolds accomplished through external piping. However, to connect the two slabs in fluid flow communication in other than a parallel cross-flow arrangement requires complex external piping. For example, U.S. Pat. No. 6,964,296 shows a flattened tube and fin heat exchanger in both a single slab and a double slab embodiment with horizontal tube runs and vertically extending fins. U.S. Patent Application Publication No. US 2009/0025914 A1 shows a double slab flatted tube and fin heat exchanger wherein each slab has vertical tube runs extending between a pair of horizontally extending manifolds and includes corrugated fins disposed between adjacent tubes.

SUMMARY OF THE INVENTION

A method is provided for fabrication of large, multiple slab flattened tube and fin heat exchangers. The disclosed method facilitates high volume semi-automated production.

In an aspect, a method is provided for assembling a flattened tube heat exchanger having a first tube bank and a second tube bank. The method includes: arraying a first plurality of flattened heat exchange tube segments in parallel spaced relationship; installing at least one spacer clip on a longitudinally extending edge of each heat exchange tube segment of the first plurality of flattened heat exchange tube segments; and arraying a second plurality of flattened heat exchange segments in parallel spaced relationship with each second heat exchange tube disposed in alignment with a respective one of the first heat exchange tube segments and engaging the at least one spacer clip installed on the respective one of the first heat exchange tube segments. The method further includes: mounting a first manifold to the respective first ends of each of the first plurality of flattened heat exchange tubes, mounting a second manifold to the respective second ends of the first plurality of flattened heat exchange tubes, mounting a third manifold to the respective first ends of each of the second plurality of flattened heat exchange tubes, and mounting a fourth manifold to the respective second ends of the second plurality of flattened heat exchange tubes, thereby forming a final assembly. The method further includes metallurgically bonding the plurality of first and second heat exchange tube segments to the respective manifolds. The metallurgical bonding may be accomplished by brazing the final assembly in a brazing furnace.

In an aspect, a method is provided for assembling a flattened tube finned heat exchanger having a first tube bank and a second tube bank. The method includes forming a tube array by: arraying a first plurality of flattened heat exchange tube segments in parallel spaced relationship; installing at least one spacer clip on a longitudinally extending edge of each heat exchange tube segment of the first plurality of flattened heat exchange tube segments; and arraying a second plurality of flattened heat exchange segments in parallel spaced relationship with each second heat exchange tube disposed in alignment with a respective one of the first heat exchange tube segments and engaging the at least one spacer clip installed on the respective one of the first heat exchange tube segments. The method further includes inserting a folded fin between each set of neighboring parallel first and second aligned flattened heat exchange tube segments to form a partially assembled fin and tube pack. The method further includes forming a final assembly by: mounting a first manifold to the respective first ends of each of the first plurality of flattened heat exchange tubes, mounting a second manifold to the respective second ends of the first plurality of flattened heat exchange tubes, mounting a third manifold to the respective first ends of each of the second plurality of flattened heat exchange tubes, and mounting a fourth manifold to the respective second ends of the second plurality of flattened heat exchange tubes. The method further includes metallurgically bonding the folded fins to the first and second heat exchange tube segments and the plurality of first and second heat exchange tube segments to the respective manifolds. The metallurgical bonding may be accomplished by brazing the final assembly in a brazing furnace.

In an aspect, the method includes limiting a depth of insertion of the respective ends of the first and second heat exchange tube segments into a respective one of the manifolds by disposing an insertion depth control rod in each manifold, and positioning each insertion depth control rod so as to extend parallel to a longitudinal axis of the manifold in which it is disposed and to oppose the direction of tube insertion.

BRIEF DESCRIPTION OF THE DRAWINGS

For a further understanding of the disclosure, reference will be made to the following detailed description which is to be read in connection with the accompanying drawings, where.

DETAILED DESCRIPTION

Figure 1:
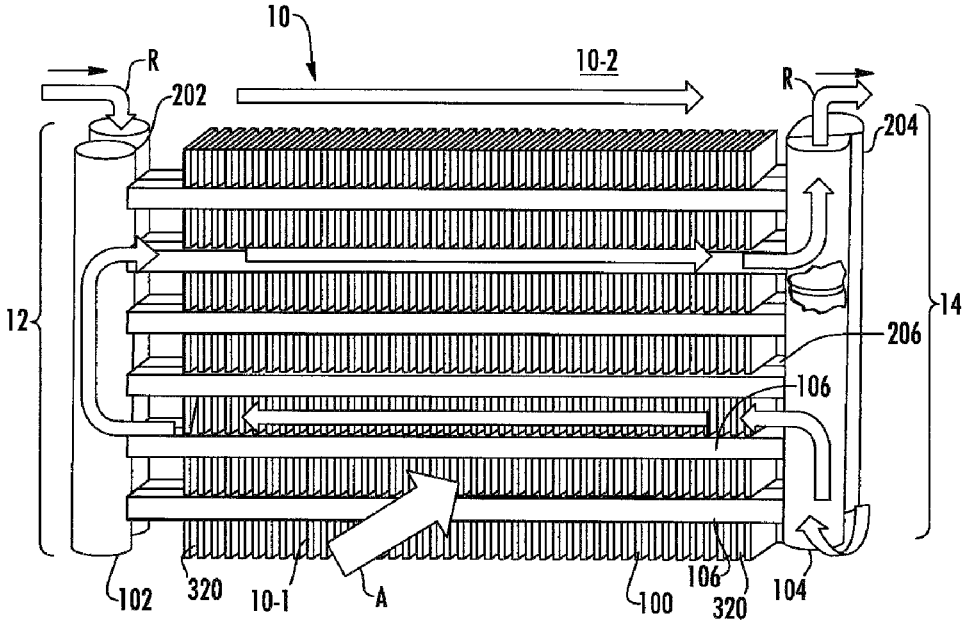
FIG. 1 is a diagrammatic illustration of an exemplary embodiment of a multiple tube bank, flattened tube finned heat exchanger as disclosed herein.

There is depicted in FIG. 1 in perspective illustration an exemplary embodiment of a multiple bank flattened tube finned heat exchanger 10 in accordance with the disclosure. The first heat exchanger slab 10-1 includes a first manifold 102, a second manifold 104 spaced apart from the first manifold 102, and a first tube bank 100 connecting the first manifold 102 and the second manifold 104 in fluid communication and including a plurality of heat exchange tube segments 106, including at least a first and a second tube segment. Similarly, the second heat exchanger slab 10-2 includes a first manifold 202, a second manifold 204 spaced apart from the first manifold 202, and a second tube bank 200 connecting the first manifold 202 and the second manifold 204 in fluid communication and including a plurality of heat exchange tube segments 206, including at least a first and a second tube segment. The first and second heat exchanger slabs 10-1, 10-2 are juxtaposed in generally adjacent relationship with the first manifold 102 of the first heat exchanger slab 10-1 and the first manifold 202 of the second heat exchanger slab 10-2 disposed at the refrigerant inlet side 12 of the heat exchanger 10 (i.e. the left side of the heat exchanger 10 as viewed in FIG. 1) and with the second manifold 104 of the first heat exchanger slab 10-1 and the second manifold 204 of the second heat exchanger slab 10-2 disposed at the refrigerant outlet side 14 of the heat exchanger 10 (i.e. the right side of the heat exchanger 10 as viewed in FIG. 1). Although a dual slab heat exchanger construction is depicted in FIG. 1, the design can be extended to multiple slabs with no limitation, primarily dictated by economics and available footprint. Also, a different number of refrigerant passes can be considered within each heat exchanger slab, primarily dictated by the refrigerant side pressure drop.

In the embodiment depicted in FIG. 1, the first manifolds 102, 202 and the second manifolds 104, 204 extend along a vertical axis. The plurality of heat exchange tube segments 106 extend longitudinally in spaced parallel relationship between and connect the first manifold 102 and the second manifold 104 in fluid communication. Similarly, the plurality of heat exchange tube segments 206 extend longitudinally in spaced parallel relationship between and connect the first manifold 202 and the second manifold 204 in fluid communication. It is to be understood, however, that one or both of the tube banks 100 and 200 may comprise one or more serpentine tubes having a plurality of heat exchange tube segments extending in longitudinally spaced parallel relationship and interconnected by return bends to form a serpentine tube connected at its respective ends between the respective first and second manifolds of the tube banks.

Figure 2:
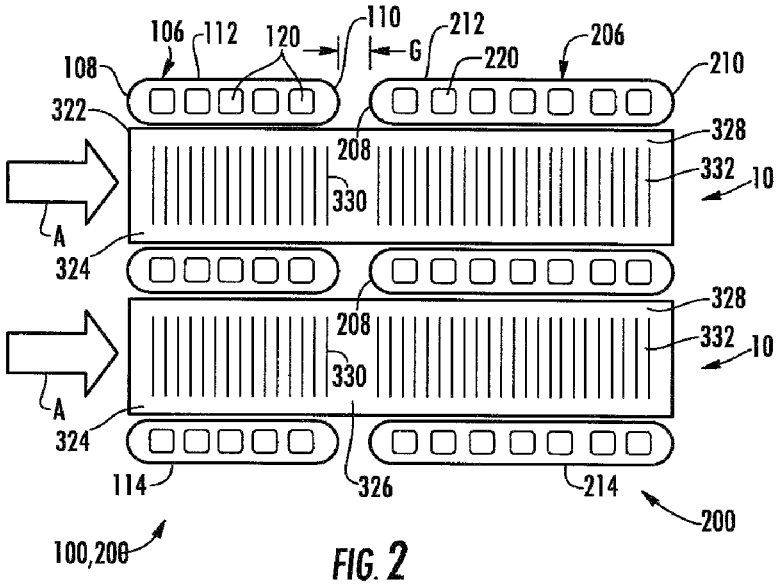
FIG. 2 is a side elevation view, partly in section, illustrating an embodiment of a fin and flattened tube assembly of the heat exchanger of FIG. 1.

Referring now to FIG. 2, there is depicted, partly in cross-section, a plurality of tube segments 106, 206 of the dual slab arrangement of the multiple bank heat exchanger 10 shown in FIG. 1 disposed in spaced parallel relationship, with a folded fin 320 disposed between each set of adjacent tube segment 106, 206. In the depicted embodiment, each of the heat exchange tube segments 106, 206 comprises a flattened heat exchange tube having a leading edge 108, 208, a trailing edge 110, 210, an upper flat surface 112, 212, and a lower flat surface 114, 214. The leading edge 108, 208 of each heat exchange tube segment 106, 206 is upstream of its respective trailing edge 110, 210 with respect to air flow through the heat exchanger 10. The interior flow passage of each of the heat exchange tube segments 106, 206 of the first and second tube banks 100, 200, respectively, may be divided by interior walls into a plurality of discrete flow channels 120, 220 that extend longitudinally the length of the tube from an inlet end of the tube to the outlet end of the tube and establish fluid communication between the respective headers of the first and the second tube banks 100, 200. In the embodiment of the multi-channel heat exchange tube segments 106, 206 depicted in FIG. 2, the heat exchange tube segments 206 of the second tube bank 200 have a greater width than the heat exchange tube segments 106 of the first tube bank 100 to provide an additional degree of flexibility for the refrigerant side pressure drop management. Also, the interior flow passages of the wider heat exchange tube segments 206 may be divided into a greater number of discrete flow channels 220 than the number of discrete flow channels 120 into which the interior flow passages of the heat exchange tube segments 106 are divided.

The second tube bank 200 of the second (rear) heat exchanger slab 10-2, is disposed behind the first tube bank 100 of the first (front) heat exchanger slab 10-1, with respect to the flow of air, A, through the heat exchanger 10, with each heat exchange tube segment 106 directly aligned with a respective heat exchange tube segment 206 and with the leading edges 208 of the heat exchange tube segments 206 of the second tube bank 200 spaced from the trailing edges 110 of the heat exchange tube segments of the first tube bank 100 by a desired spacing, G. In the embodiment depicted in FIG. 2, the desired spacing, G, is established by an open gap, thereby providing an open water/condensate drainage space between the trailing edge 110 and the leading edge 208 of each set of aligned heat exchange tube segments 106, 206 along the entire length of the heat exchange tube segments 106, 206. The ratio of the flattened tube segment depth and gap G is defined by thermal and drainage characteristics and may range between 1.2 and 6.0, with the optimum residing between 1.5 and 3.0.

The flattened tube finned heat exchanger 10 disclosed herein further includes a plurality of folded fins 320. Each folded fin 320 is formed of a single continuous strip of fin material tightly folded in a ribbon-like fashion thereby providing a plurality of closely spaced fins 322 that extend generally orthogonal to the flattened heat exchange tubes 106, 206. Typically, the fin density of the closely spaced fins 322 of each continuous folded fin 320 may be about 18 to 25 fins per inch (about 7 to 10 fins per centimeter), but higher or lower fin densities may also be used. In an embodiment, each fin 322 of the folded fin 320 may be provided with louvers 330, 332 formed in the first and third sections, respectively, of each fin 322. The louver count and louver geometry may be different within each section of the fins 322 and may be related to the respective flattened tube depth.

The depth of each of the ribbon-like folded fin 320 extends at least from the leading edge 108 of the first tube bank 100 to the trailing edge of 210 of the second bank 200 as illustrated in FIG. 2. Thus, when a folded fin 320 is installed between a set of adjacent heat exchange tube segments in the assembled heat exchanger 10, a first section 324 of each fin 322 is disposed within the first tube bank 100, a second section 326 of each fin 322 spans the spacing, G, between the trailing edge 110 of the first tube bank 100 and the leading edge 208 of the second tube bank 200, and a third section 328 of each fin 322 is disposed within the second tube bank 200. In an embodiment (not shown) of the flattened tube finned heat exchanger 10, with respect to the first tube bank 100, the leading portion 336 of each folded fin 320 may extend upstream with respect to air flow through air side pass of the heat exchanger 10 so as to overhang the leading edges 108 of the flattened tube segments 106 of the first tube bank 100. The ratio of the flattened tube segment depth (leading edge to trailing edge) to fin depth (leading edge to trailing edge) is defined by thermal and drainage characteristics and in an embodiment is positioned between 0.30 and 0.65, inclusive, and in another embodiment resides between 0.34 and 0.53, inclusive. Similarly, the ratio of the fin overhang to the flattened tube segment depth is defined by thermal and drainage characteristics and ranges between 0 and 0.5, inclusive, and in an embodiment is between 0.13 and 0.33, inclusive.

Heat exchange between the refrigerant flow, R, and air flow, A, occurs through the outer surfaces 112, 114 and 212, 214, respectively, of the heat exchange tube segments 106, 206, collectively forming the primary heat exchange surface, and also through the heat exchange surface of the fins 322 of the folded fin 320, which forms the secondary heat exchange surface. In the multiple bank, flattened tube finned heat exchanger 10 disclosed herein, because the fins 322 of the folded fin 320 span the spacing, G, the ratio of the surface area of the primary heat exchange surface to the surface area provided by the secondary heat exchange surface may be selectively adjusted without changing the width of the tube segments or the spacing between parallel tube segments. Rather during the design process, the depth of the spacing, G, may be increased to increase the surface area provided by the folded fin 320, thereby decreasing the ratio of primary to secondary heat exchange surface, or may be decreased to decrease the surface area provided by the folded fin plate 320, thereby increasing the ratio of primary to secondary heat exchange surface. The ratio of primary heat exchange surface to secondary heat exchange surface may also be decreased by increasing the overall fin depth by increasing the distance by which the leading portion 336 of the folded fin 320 extends upstream with respect to air flow, A, beyond the face of the heat exchanger 10 and/or by reducing the number of flatted tube rows forming the tube banks of both the heat exchanger slabs.

Figure 3:
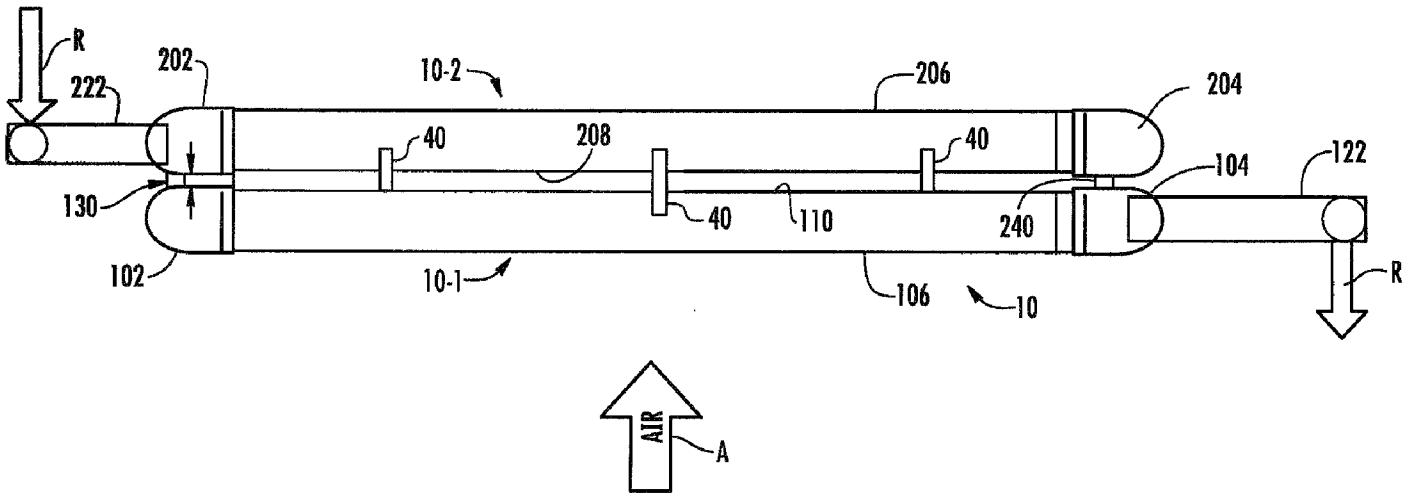
FIG. 3 is a top plan view of the heat exchanger of FIG. 1.

In accordance with an embodiment of the method disclosed herein for fabrication of a multiple bank heat exchanger, to maintain during assembly of the heat exchanger the proper spacing, G, between the tube banks 100 and 200, at least one spacer clip 40 is disposed between each set of aligned forward tube segments 106 and rear tube segments 206. Typically, a plurality of spacer clips 40 may be disposed between disposed between each set of aligned forward tube segments 106 and rear tube segments 206, the plurality of clips 40 being disposed at longitudinally spaced intervals, for example, such as illustrated in FIG. 3. When installed, each spacer clip 40 maintains a distance between the trailing edge 110 of each tube segment 106 of the first tube bank 100 and the leading edge 208 of each tube segment 206 of the second tube bank 200 equal to the desired spacing, G, through the fabrication process. The number of clips 40 disposed along the longitudinal length of a tube segment 106, 206 depends upon the length of the tube segment, In general, the longer the tube segments, the greater the number of clips 40 used. In an embodiment, the ratio between the spacing between clips 40 to the length of the heat exchanger tube segments may range between 1 to 2 and 1 to 8.

Various embodiments of the spacer clip 40 are illustrated in FIGS. 4-7. In the embodiment depicted in FIG. 4, the spacer clip 40 comprises a generally rectangular body 42 having a single groove 44 extending inwardly in an end face 46 of the body 42, the groove 44 having a depth and a width. In the embodiment depicted in FIG. 5, the spacer clip 40 comprises a generally rectangular body 42 having multiple grooves 44 extending inwardly in an end face 46 of the body 42, each groove 44 having a depth and a width. Such a clip forming a comb-like shape can extend over the entire heat exchanger height encompassing all the tubes. In this case, two fin strips will be positioned between the adjacent tubes on both sides of the comb-like clip. In the embodiment depicted in FIG. 6, the spacer clip 40 comprises a generally rectangular body 42 having a single groove 44 extending inwardly in each of the opposite end faces 46, 48 of the body 42, each groove 44 having a depth and a width. In the embodiment depicted in FIG. 7, the spacer clip 40 comprises a generally rectangular body 42 having multiple grooves 44 extending inwardly in each of the opposite end faces 46, 48 of the body 42, each groove 44 having a depth and a width. Once again, such a clip forming a twin comb-like shape can extend over the entire heat exchanger height encompassing all the tubes. Similarly, two fin strips will be positioned between the adjacent tubes on both sides of the twin comb-like clip. In the embodiment, the twin comb-like shape can represent an intermediate tube sheet where the grooves become holes through which the tubes are inserted during the assembly process.

When installed during assembly of the heat exchanger 10, each spacer clip 40 receives a leading edge or a trailing edge of a respective one of the heat exchange tube segments 106, 206. The width of each groove is sized relative to thickness of the respective heat exchange tube segments 106, 206 to ensure a snug interference fit of the respective heat exchange tube segment into the groove 44. The depth of each groove 44 is sized relative to the width of the respective heat exchange tube segments 106, 206 to receive at least a substantial extent of the width of the respective heat exchange tube segment 106, 206. The spacer clips 40 remain in position throughout the fabrication process and following completion of the fabrication process.

Figure 4:
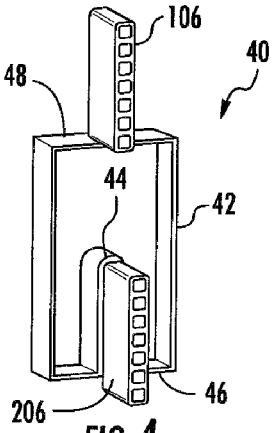
FIG. 4 is side perspective view, partly in section, illustrating placement of an embodiment of a spacer clip as installed during assembly of the multiple bank heat exchanger of FIG. 1.
Figure 5:
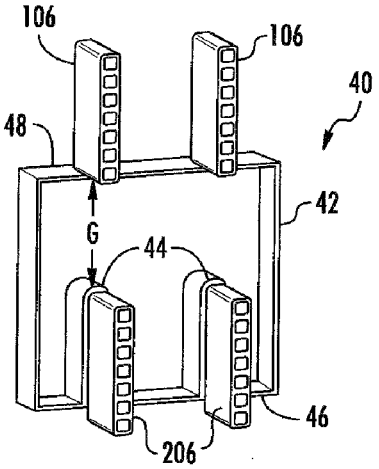
FIG. 5 is side perspective view, partly in section, illustrating placement of another embodiment of a spacer clip as installed during assembly of the multiple bank heat exchanger of FIG. 1.

In the embodiments depicted in FIGS. 4 and 5, a second heat exchange tube segment 206 (i.e. the aft tube segment) is received in each groove 44 of each spacer clip 40 and the trailing edge 110 of the aligned first heat exchange tube segment 106 (i.e. the forward tube segment) abuts against the opposite end face 48 of the body 42 of the spacer clip 40. In these embodiments, the distance between the base of each groove 44 and the end face 48 is equal to the desired spacing, G, to be maintained between the trailing edge 110 of the first heat exchange tube segment 106 (i.e. the forward tube segment) and the leading edge 208 of the second heat exchange tube segment 206 (i.e. the aft tube segment).

Figure 6:
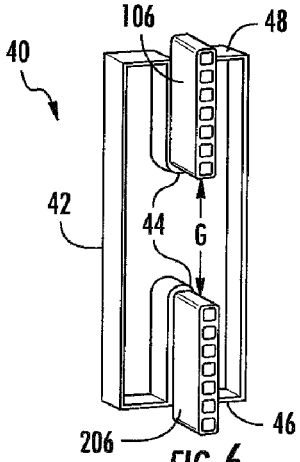
FIG. 6 is side perspective view, partly in section, illustrating placement of another embodiment of a spacer clip as installed during assembly of the multiple bank heat exchanger of FIG. 1.
Figure 7:
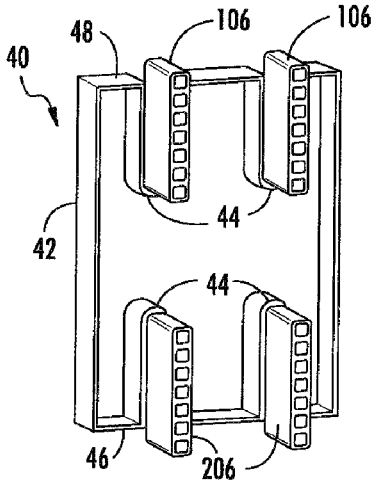
FIG. 7 is side perspective view, partly in section, illustrating placement of still an embodiment of a spacer clip as installed during assembly of the multiple bank heat exchanger of FIG. 1.

In the embodiments depicted in FIGS. 6 and 7, a second heat exchange tube segment 206 (i.e. the aft tube segment) is received in each groove 44 in the end face 46 of the body 42 of each spacer clip 40 and the trailing edge 110 of the aligned first heat exchange tube segment 106 (i.e. the forward tube segment) is received in each groove 44 in the opposite end face 48 of the body 42 of the spacer clip 40. In these embodiments, the distance between to base of each groove 44 in the end face 46 of the body 42 and the base of each groove 44 in the end face 48 of the body 42 is equal to the desired spacing, G, to be maintained between the trailing edge 110 of the first heat exchange tube segment 106 (i.e. the forward tube segment) and the leading edge 208 of the second heat exchange tube segment 206 (i.e. the aft tube segment).

In an embodiment of the method disclosed herein for fabricating the flattened tube heat exchanger 10, the first and second tube banks are assembled to form a multiple bank tube array. A first plurality of flattened heat exchange tube segments, for example the second (aft) heat exchange tube segments 206 forming the second tube bank 200, are arrayed in parallel spaced relationship with their trailing edges 210 lying in a common plane. At least one spacer clip 40, and generally multiple spacer clips 40 disposed at longitudinally spaced intervals, are installed on a longitudinally extending leading edge 208 of each heat exchange tube segment 206 in the array of flattened heat exchange tube segments forming the second tube bank 200. The first tube bank 100 is then assembled by arraying a second plurality of flattened heat exchange segments 106 in parallel spaced relationship with each heat exchange tube segment 106 disposed in alignment with a respective one of the heat exchange tube segments 206 and engaging the at least one spacer clip 40, or engaging each of the multiple spacer clips 40, as the case may be, installed on the leading edge 208 of the respective one of the heat exchange tube segments 206.

After the multiple tube bank assembly has been assembled, a folded fin 320 may be inserted between each set of neighboring parallel first and second aligned flattened heat exchange tube segments to form a partially assembled fin and tube pack. As noted previously, each folded fin 320 defines a plurality of fins 322 each of which extends continuously at least from the leading edges 108 of the heat exchange tube segments 106 of the first tube bank 100 to the trailing edges 210 of the heat exchange tube segments 206 of the second (aft) tube bank 200, and may, if desired, overhang the leading edges 108 of the heat exchange tube segments 106 of the first (forward) tube bank 100.

The final assembly of the multiple bank flattened tube finned heat exchanger 10 is constructed by: mounting the manifold 102 to the respective first ends of each of the plurality of flattened heat exchange tube segments 106 forming the first tube bank 100, mounting the manifold 104 to the respective second ends of the plurality of flattened heat exchange tube segments 106 forming the first tube bank 100, mounting the manifold 202 to the respective first ends of each of the plurality of flattened heat exchange tube segments 206 forming the second tube bank 200, and mounting the manifold 204 to the respective second ends of the plurality of flattened heat exchange tube segments 206 forming the second tube bank 200. The method further includes metallurgically bonding the folded fins 320 to the first and second heat exchange tube segments 106, 206 and the plurality of first and second heat exchange tube segments 106, 206 to the respective manifolds 102, 104 and 202, 204. The metallurgical bonding may be accomplished by brazing the final assembly in a brazing furnace.

In a variation of the above described method, the folded fins 320 may be inserted into the assembled array of spaced parallel heat exchange tubes 206 forming the second tube bank 200 before assembling the first tube bank 100 in alignment with the second tube bank 200. In this variation, after the spacer clips 40 are installed on a longitudinally extending leading edge 208 of each heat exchange tube segment 206 in the array of flattened heat exchange tube segments forming the second tube bank 200, a folded fin 320 is inserted in the space between each set of neighboring heat exchange tube segments 206 in the array of flattened heat exchange tube segments forming the second tube bank 200. Then, each of the heat exchange tube segments 106 forming the first tube bank 100 is installed in alignment with a respective one of the heat exchange tube segments 206 forming the second tube bank 200 and in engagement with one or more spacer clips 40, thereby forming a tube and fin pack comprising an array of aligned forward heat exchange tube segments 106 and aft heat exchange tube segments 206 with a folded fin 320 disposed therebetween in an alternating arrangement, for example, as illustrated in FIG. 1.

Figure 8:
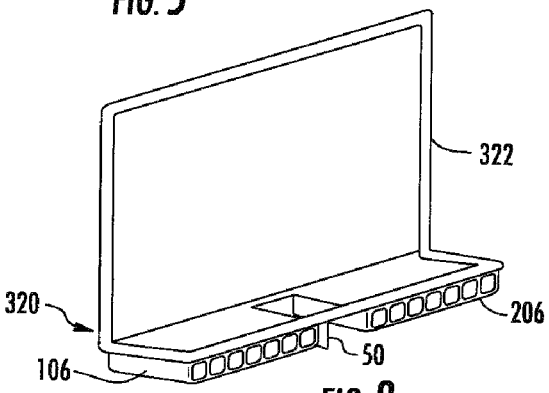
FIG. 8 is a side perspective view, partly in section, illustrating another method of spacing the forward and aft tubes during assembly of the multiple bank heat exchanger disclosed herein.

Referring to FIG. 8, in another embodiment of the method disclosed herein for fabrication of the multiple bank flattened tube finned heat exchanger 10, the spacer clips 40 are eliminated. In this embodiment, to maintain the proper spacing, G, between the tube banks 100 and 200 during assembly of the heat exchanger, a spacer tab 50 is cut in the fold between fins 322 of the folded fin 320 abutting upper surface of the aligned heat exchange tube segments 106, 206. The spacer tab 50 is cut on three sides and bent back along its uncut base downwardly to provide a support surface on which the trailing edge 110 of the first heat exchange tube segment abuts when placed in assembly during the fabrication process. The cut in the fold of the fin is located such that the spacer tap 50 when bent back positions the trailing edge 110 of the first heat exchange tube segment 106 (i.e. the forward tube segment) at a distance from the leading edge 208 of the second heat exchange tube segment 206 equal to the desired spacing, G. It is to be understood that in practice, it would not be necessary to cut a spacer tab 50 in every fold of the folded fin 320. Rather, spacer tabs 50 would be cut in selected folds at longitudinally spaced intervals along the length of the folded fin.

In this embodiment, after the heat exchange tube segment 206 are arranged in spaced, parallel arrangement on their respective trailing edges on a work surface to form an array of flattened heat exchange tube segments forming the second tube bank 200, a folded fine 320 is inserted in the space between each set of neighboring heat exchange tube segments 206 in the array of flattened heat exchange tube segments forming the second tube bank 200. Each folded fin has precut therein at least one spacer tab 50 as herein before described. Then, each of the heat exchange tube segments 106 forming the first tube bank 100 is installed in alignment with a respective one of the heat exchange tube segments 206 forming the second tube bank 200 and seated on the support surface of the spacer tabs 50. The spacer tabs 50 are precut in selected folds of the folded fins 320 such that when seated on the support surface provided by the spacer tabs, the trailing edges 110 of the forward heat exchange tube segments 106 are spaced the desired spacing, G, from the leading edges 208 of the aft heat exchange tube segments 206.

In the assembly of the heat exchanger 10, it is desirable to limit the depth of insertion of the respective ends of the heat exchange tube segments 106, 206 into the manifolds 102, 104 and 202, 204, respectively. During manufacture of the manifolds 102, 104, 202, 204, slots 162 are cut, punched or otherwise machined into the manifolds at appropriate locations for receiving the ends of the tube segments 106, 206. The receiving slots 162 are sized to receive an end of a respective one of the heat exchange tube segments 106, 206 in a snug interference fit. If the neighboring manifolds 104 and 204 or 102 and 202 are formed as a single piece extrusion or formed separately but welded or otherwise connected together, the slots 162 may be simultaneously punched in both manifolds of the pair. If the neighboring manifolds are separate bodies, an integral one-piece end cap covering each manifold end and maintaining a desired separation between the manifolds may be inserted simultaneously into the ends of the manifolds at each end of the paired manifolds to control manifold spacing during the simultaneous punching of slots 162 in the paired manifolds and during assembly of the heat exchange tube segments 106, 206 into the slots 162.

Figure 9:
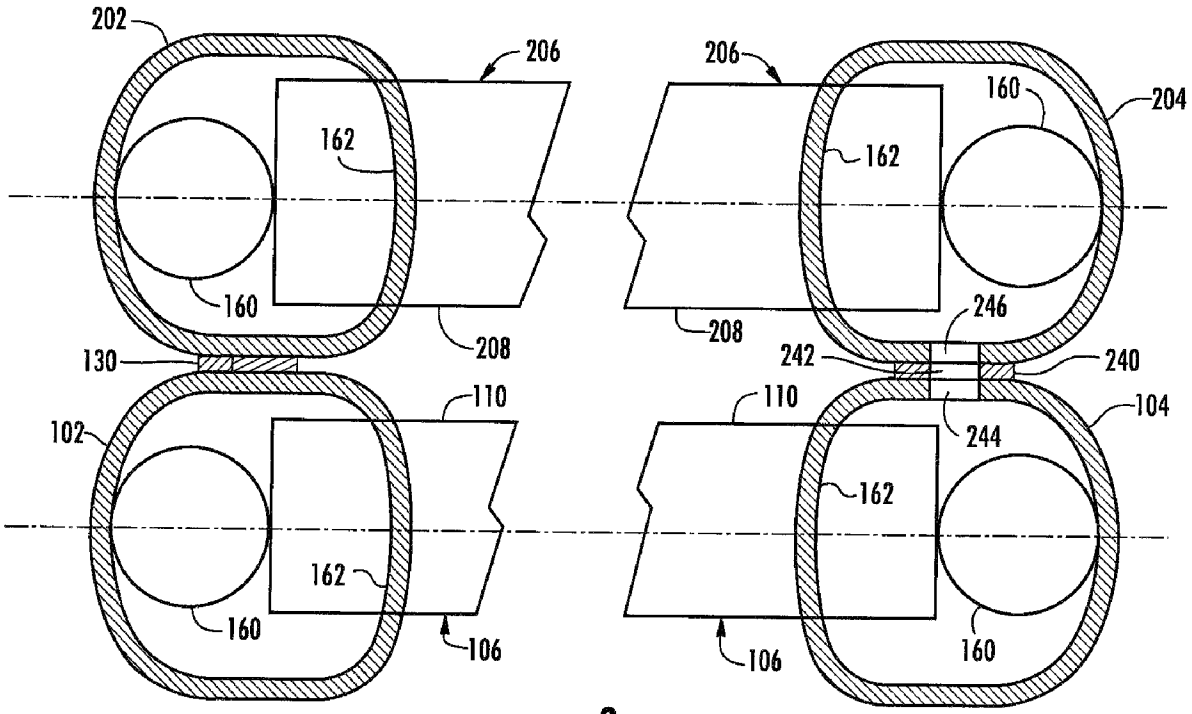
FIG. 9 is a plan view, partly in section, illustrating assembly of the respective manifolds and tube banks during fabrication of the multiple bank heat exchanger as disclosed herein.
Figure 10:
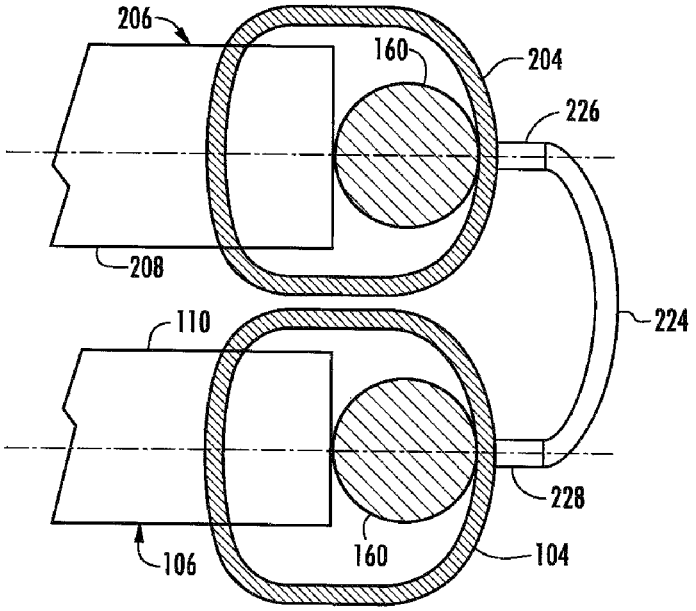
FIG. 10 is a plan view, partly in section, illustrating one method for assembly of an external fluid flow connection between the manifolds at the right side of the multiple bank heat exchanger illustrated in FIG. 9.
Figure 11:
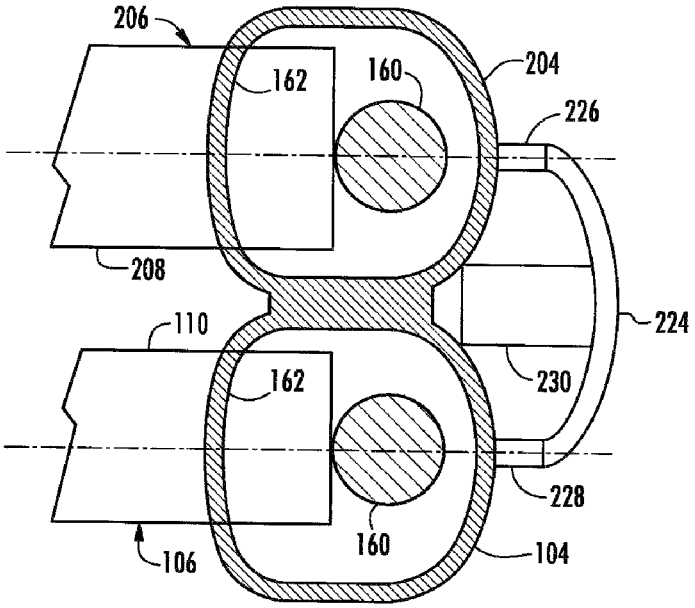
FIG. 11 is a plan view, partly in section, illustrating another method for assembly of an external fluid flow connection between the manifolds at the right side of the multiple bank heat exchanger as illustrated in FIG. 9.

Referring now to FIGS. 9-11, in accordance with an aspect of the method disclosed herein for fabrication of a multiple bank heat exchanger, an insertion depth control rod 160 is inserted into each manifold 102, 104, 202, 204 prior to assembly the manifolds to the respective ends of the heat exchange tube segments 106, 206. Each insertion depth control rod 160 is positioned within the interior chamber of its respective manifold opposite the side of the manifold into which are formed the slots 162 into which the tube ends are to be inserted. During the assembly process, each tube end is inserted into a respective receiving slot 162 in a respective one of the manifolds 102, 104, 202, 204 until the end of the heat exchange tube segment strikes the insertion depth control rod 160 positioned in the manifold. The diameter of the insertion depth control rod 160 is sized relative to the interior dimension in the direction of insertion of the respective manifold in which the control rod is positioned to limit depth of insertion to a desired depth, thereby preventing over insertion of the tube ends into the interior chamber of the manifold.

Figure 12:
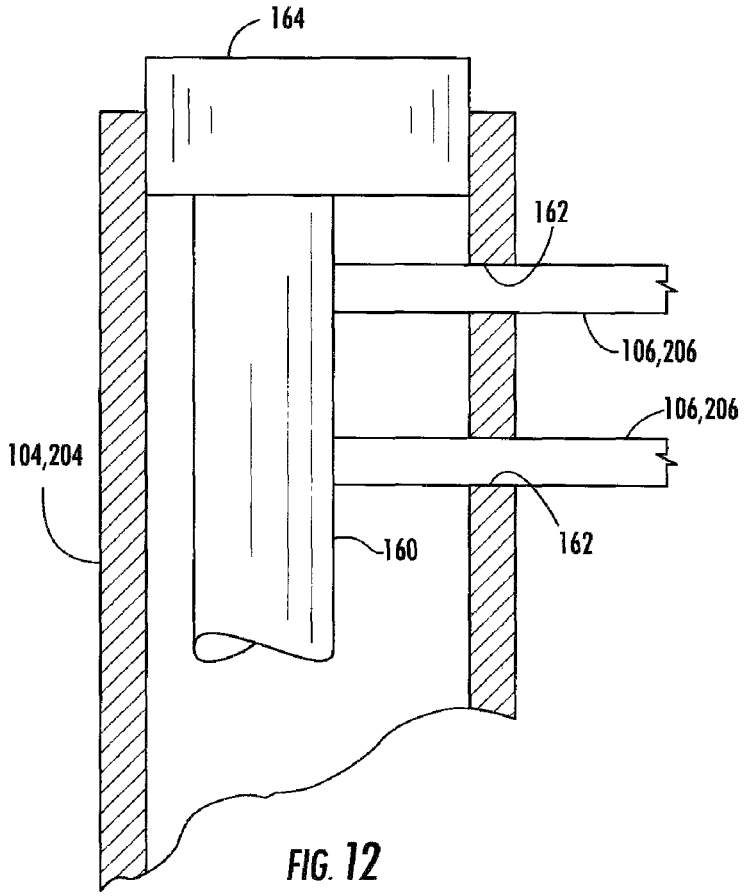
FIG. 12 is a side elevation view, partly in section, of a manifold wherein a stepped insertion depth control rod has been positioned.

In the embodiment depicted in FIG. 9, the insertion depth control rods 160 are of a uniform diameter along their longitudinal length and are positioned against the inside wall of the manifold opposite the slots 162. In the embodiment depicted in FIG. 10, the insertion depth controls rods 160 are positioned away from the inside wall of the manifold, while still being positioned to extend longitudinally along the interior chamber of the manifold to limit the depth of insertion of the ends of the tube segments extending through the receiving slots 162. In this embodiment, the insertion depth control rod 160 can include a stepped portion 164, as illustrated in FIG. 12, which is sized to establish an interference fit with the inside wall of the manifold so as to hold the insertion depth control rod 160 in a desired positioned during the assembly process of inserting the ends of the tube segments into the receiving slots.

In the embodiment depicted in FIG. 9, the manifolds 104 and 204 in are connected in direct fluid flow communication through a flow passage defined by a central bore 242 in a block insert 240 positioned between the manifolds 104 and 204 as illustrated in FIG. 9. The block insert 240 is positioned such that the central bore 242 aligns with holes 244 and 246 formed through the respective walls of the manifolds 104 and 204, respectively. So aligned a continuous flow passage is established through which refrigerant may pass from the interior of the second manifold 204 of the second tube bank 200 through the hole 246, thence through the central bore 242 of the block insert 240, and thence through the hole 244 into the interior of the second manifold 104 of the first tube bank 100. The side faces of the block insert 240 are contoured to match and mate with the contour of the abutting external surface of the respective manifolds 104, 204. The block insert 240 is metallurgically bonded, for example by brazing or welding, to each of the second manifolds 104 and 204.

In the embodiments depicted in FIGS. 10 and 11, the neighboring manifolds 104 and 204 are connected in fluid flow communication through at least one external conduit 224 opening at a first end 226 into the interior chamber of the manifold 204 of the second tube bank 200 and opening at a second end 228 into the interior chamber of the manifold 104 of the first tube bank 100. In fabrication of the heat exchange unit 10, after assembly of the second manifolds 104 and 204 to the first and second tube banks 100, 200, respectively, the first end 226 of the conduit 224 is inserted into a mating hole extending through the wall of the second manifold 204 of the second tube bank 200 and the second end 228 of the conduit 24 is inserted into a mating hole extending through the wall of the second manifold 104 of the second tube bank 100. More than one conduit 224 may be provided to establish fluid flow communication between the second manifold 104 and the second manifold 204. For example, a plurality of external conduit 224 may be provided at spaced longitudinal intervals.

In an embodiment of the method disposed herein, each conduit 224 is installed before the insert depth control rods 160 are removed from the manifolds 104, 204. Thus, as illustrated in FIG. 10, the depth insertion control rods 160, which are disposed along the inside wall of the manifold opposite the receiving holes 162, limit the depth of insertion of the ends 226 and 228 into the manifolds 204, 104, respectively, thereby preventing over insertion of the ends 226, 228 into the manifolds.

In another embodiment of the method disclosed herein, the depth insertion control rods 160 are removed from the manifolds 104, 204 and end caps secured to the respective ends of the manifolds before the external conduit 224. To guard against an excessive depth of insertion of the first and second ends 226, 228 of the conduit 224 into the manifolds 104, 204, respectively, a block or rod 230 may be temporarily positioned, as depicted in FIG. 11, between the conduit 224 and the external surface of the manifolds 104, 204 to restrict the depth of insertion of the first and second ends 226, 228 of the conduit 230 into the respective mating holes of the first manifold 104 and the second manifold 204. After the first and second ends 226, 228 of the conduit 224 are metallurgically bonded, for example by brazing or welding, to the second manifolds 104 and 204, respectively, the block 230 may be removed.

While the present invention has been particularly shown and described with reference to the exemplary embodiments as illustrated in the drawing, it will be recognized by those skilled in the art that various modifications may be made without departing from the spirit and scope of the invention. For example, it is to be understood that the multiple bank flattened tube finned heat exchanger 10 disclosed herein may include more than two tube banks. It is also to be understood that the tube banks 100, 200 could include serpentine tubes with the heat exchange tube segments 106, 206 being parallel linear tube segments connected by U-bends or hairpin turns to form a serpentine tube connected at its respective ends between the first manifold and the second manifold of the heat exchanger slab. Further, although the multiple tube bank heat exchanger disclosed herein is depicted having flattened tube segments, various aspects of the invention may be applied to multiple bank heat exchangers having round tubes or other forms of non-round tubes. Therefore, it is intended that the present disclosure not be limited to the particular embodiment(s) disclosed as, but that the disclosure will include all embodiments falling within the scope of the appended claims.

We claim:

1. A method for assembling a flattened tube heat exchanger having a first tube bank and a second tube bank, the method comprising:

arraying a plurality of flattened heat exchange tube segments in parallel spaced relationship in a first layer;

installing at least one spacer clip on a longitudinally extending edge of each heat exchange tube segment of the plurality of flattened heat exchange tube segments in the first layer; and arraying a plurality of flattened heat exchange tube segments in parallel spaced relationship in a second layer and disposing each heat exchange tube segment of the plurality of flattened heat exchange tube segments in the second layer in alignment with a respective one of the heat exchange tube segments of the plurality of flattened heat exchange tube segments in the first layer and in engagement with the at least one spacer clip installed on the heat exchange tube segment of the plurality of flattened heat exchange tube segments in the first layer;

wherein said spacer clip has a body having a first edge having an inwardly extending groove having a depth and a width, and the installing the at least one spacer clip comprises receiving the longitudinally extending edge of the heat exchange tube exchange tube segment of the plurality of flattened heat exchange tube segments in the first layer into said groove in the first edge.

2. The method as recited in claim 1 further comprising inserting a folded fin between each set of neighboring parallel aligned flattened heat exchange tube segments of the plurality of flattened heat exchange tube segments in the first layer and the second layer to form a partially assembled fin and tube pack.

3. The method as recited in claim 2 further comprising:

mounting a first manifold to respective first ends of each of the plurality of flattened heat exchange tube segments of the plurality of flattened heat exchange tube segments in the first layer:

mounting a second manifold to respective second ends of the plurality of flattened heat exchange tube segments of the plurality of flattened heat exchange tube segments in the second layer;

mounting a third manifold to respective first ends of each of the plurality of flattened heat exchange tube segments of the plurality of flattened heat exchange tube segments in the second layer; and mounting a fourth manifold to respective second ends of the plurality of flattened heat exchange tube segments of the plurality of flattened heat exchange tube segments in the second layer, thereby forming a final assembly.

4. The method as recited in claim 3, the first manifold having a slot formed in a wall thereof for receiving an end of a heat exchange tube segment of the plurality of flattened heat exchange tube segments in the first layer and, the method comprising;

positioning an insertion depth control rod within an interior chamber of said first manifold opposite the receiving slot; and inserting an end of the heat exchange tube segment of the plurality of flattened heat exchange tube segments in the first layer through the receiving slot until contact is made with said insertion depth control rod.

5. The method as recited in claim 4 further comprising sizing the receiving slot to establish an interference fit between the heat exchange tube segment of the plurality of flattened heat exchange tube segments in the first layer and the first manifold when the heat exchange tube segment of the plurality of flattened heat exchange tube segments in the first layer is inserted through the receiving slot.

6. The method as recited in claim 4 further comprising providing a stepped portion on said insertion depth control rod, the stepped portion being sized to provide an interference fit between the stepped portion and an inside wall of the first manifold.

7. The method as recited in claim 4 further comprising positioning said insertion depth control rod against an inside wall of the first manifold opposite the receiving slot.

8. The method as recited in claim 7 further comprising:

providing a hole opening into the interior chamber of the first manifold opposite the receiving slot;

disposing said insertion depth control rod positioned against the inside wall of the first manifold over said hole; and inserting an end of an external flow conduit into said hole until the end of the external flow conduit contacts said insertion depth control rod.

9. The method as recited in claim 3 further comprising bonding the folded fins to the plurality of heat exchange tube segments of the plurality of flattened heat exchange tube segments in the first layer and the second layer and bonding the plurality of heat exchange tube segments of the plurality of flattened heat exchange tube segments in the first layer and the second layer to respective manifolds.

10. The method as recited in claim 9 wherein the bonding the folded fins to the plurality of heat exchange tube segments of the plurality of flattened heat exchange tube segments in the first layer and the second layer and bonding the plurality of heat exchange tube segments of the plurality of flattened heat exchange tube segments in the first layer and the second layer to the respective manifolds comprises brazing the final assembly in a brazing furnace.

11. The method as recited in claim 1 wherein the disposing each heat exchange tube segment of the plurality of flattened heat exchange tube segments in the second layer in engagement with the at least one spacer clip comprises disposing each heat exchange tube segment of the plurality of flattened heat exchange tube segments in the second layer in abutting relationship with a second edge of the body of said at least one spacer clip.

12. The method as recited in claim 1 wherein the body of said spacer clip has a second edge opposite the first edge, the second edge having an inwardly extending groove having a depth and a width, and wherein the disposing each heat exchange tube segment of the plurality of flattened heat exchange tube segments in the second layer in engagement with the at least one spacer clip comprises inserting a longitudinally extending edge of each heat exchange tube segment of the plurality of flattened heat exchange tube segments in the second layer into a respective groove in the second edge of the body of said at least one spacer clip.

13. The method as recited in claim 1 wherein said at least one spacing clip comprises a plurality of longitudinally spaced clips disposed at spaced intervals along the length of the heat exchange tube segment, the ratio of a spacing between clips to the length of the heat exchange tube segment ranging between 1 to 2 and 1 to 8.

14. A method for assembling a flattened tube heat exchanger having a first tube bank and a second tube bank, the method comprising:

arraying a plurality of flattened heat exchange tube segments in parallel spaced relationship in a first layer;

installing at least one spacer clip on a longitudinally extending edge of each heat exchange tube segment of the plurality of flattened heat exchange tube segments in the first layer; and arraying a plurality of flattened heat exchange tube segments in parallel spaced relationship in a second layer and disposing each heat exchange tube segment of the plurality of flattened heat exchange tube segments in the second layer in alignment with a respective one of the heat exchange tube segments in the first layer and in engagement with the at least one spacer clip installed on the heat exchange tube segment of the plurality of flattened heat exchange tube segments in the first layer;

wherein the heat exchanger includes a first manifold and a second manifold, an interior chamber of the first manifold in fluid communication with an interior chamber of the second manifold disposed in side-by-side relationship with the first manifold, the method comprising:

providing an external flow conduit having a pair of generally parallel legs connected by a central section;

providing a hole through the first manifold opening to the interior chamber of the first manifold;

providing a hole through the second manifold opening to the interior chamber of the second manifold;

inserting a first leg of the external flow conduit into the hole in the first manifold and inserting a second leg of the external flow conduit into the hole in the second manifold;

positioning an insertion depth control block extending between the central section of the external flow conduit and an exterior surface of each of the first and second manifolds, thereby limiting the depth of insertion of the first and second legs of the external flow conduit into the respective first and second manifolds; and;

bonding the inserted first and second legs of the external flow conduit to the respective first and second manifolds.

15. The method as recited in claim 14 further comprising attaching the first and second manifolds together to form a longitudinally extending manifold preassembly.

16. The method as recited in claim 15 wherein providing a hole through the first manifold and providing a hole through the second manifold comprises simultaneously providing a hole through the first manifold and providing a hole through the second manifold in a single operation.

17. The method as recited in claim 14 further comprising:

forming a manifold preassembly by inserting a first common single piece end cap into a first end of each of the first manifold and the second manifold and by inserting a second common single piece end cap into a second end of each of the first manifold and the second manifold.

* * * * *